US005199787A

United States Patent [19]

King et al.

[11] Patent Number: 5,199,787

[45] Date of Patent: Apr. 6, 1993

[54] REFLECTOR LAMP HAVING IMPROVED LENS

[75] Inventors: Gary L. King, Sterling Heights, Mich.; Jerry W. Smith, Irvine, Ky.

[73] Assignee: North American Philips Corporation, New York, N.Y.

[21] Appl. No.: 818,006

[22] Filed: Jan. 8, 1992

[51] Int. Cl.[5] ..... F21V 7/00

[52] U.S. Cl. ..... 362/310; 362/328; 313/113

[58] Field of Search ..... 362/223, 309, 310, 328, 362/329; 313/113

[56] References Cited

U.S. PATENT DOCUMENTS 4,473,872 9/1984 Puckett et al. ..... 362/309
4,494,176 1/1985 Sands et al. ..... 362/309 X
4,506,316 3/1985 Thiry et al. ..... 362/309

*Primary Examiner*—Stephen F. Husar
*Attorney, Agent, or Firm*—Paul R. Miller

[57] ABSTRACT

A reflector lamp having a lens with an annular surface portion which surrounds a central stippled portion. The annular portion includes a plurality of beam forming elements in the form of oblique flutes which extend at an acute angle to respective radius through the optical axis. According to a preferred embodiment, the flutes are also curved in the plane of the lens surface according to an arc of circle.

16 Claims, 2 Drawing Sheets

REFLECTOR LAMP HAVING IMPROVED LENS

BACKGROUND OF THE INVENTION

The invention relates to reflector lamps of the type having a reflector defining an optical axis, a light-source disposed within said reflector and substantially surrounded thereby, and a lens adjacent said reflector having an annular portion which includes a pattern of elongate beam forming elements.

Such a lamp is known from U.S. Pat. No. 4,506,316 (Thiry et al) which discloses a reflector lamp of the PAR (Parabolic Aluminized Reflector) type. PAR lamps are well known in the prior art and have been used extensively for general spot and flood lighting applications. As shown in Thiry, they typically have a reflector body having a parabolic front, or forward, section, a middle reflective section of substantially spherical shape having its focus at the focus of the parabolic section, and a rear section also of substantially spherical shape. A light source, such as an incandescent filament, halogen capsule, or high intensity discharge (HID) arc tube, is focally arranged with its principle axis either aligned with or perpendicular to the optical axis. A lens is sealed to the reflector body, providing a sealed weatherproof unit. PAR lens's typically include stippling, a pattern of lenticules, and/or elongate beam forming elements, such as flutes, to manipulate the light beam emanating from the reflector. The reflector and lens are typically of hard glass and include a medium screw-type or side prong base at the rear of the reflector for connecting the light source to a source of electric power.

In the Thiry PAR lamp, the light source is aligned with the optical axis. The lens has a circular central stippled portion bounded by an annular portion having a plurality of flutes extending substantially radially outward from the stippled portion. In one Thiry embodiment, the flute side edges are straight and extend radially from the optical axis, providing a tapered flute. Thiry also discloses embodiments having pairs of non-tapered flutes with parallel straight side edges. Each flute pair has a common straight side edge which extends radially from the focal axis.

U.S. Pat. No. 4.651.261 (Szekacs) and U.S. Pat. No. 4.473,872 (Puckett et al) disclose PAR lamps with the light source arranged perpendicular to the optical axis. Szekacs' lens has a central stippled portion with a regular pattern of lenticules and oblong beam forming elements parallel to the light source while Puckett's lens has a plurality of concentric fluted rings and an outer annular stippled portion.

It has been found advantageous to arrange the light source coaxial with the optical axis of the reflector. However, in doing so, it is often necessary for a rigid current conductor to axially extend the length of the light source to connect with its end remote from the lamp base. In any lamp having a parabolic reflector, such a conductive support parallel to the light source will create an objectionable shadow in the light beam projected from the reflector. The greater the diameter of the support with respect to the light source, the larger the shadow. Also, the closer the support to the light source, the larger the shadow. In some lamp designs with axial filaments, it becomes necessary to use supports with a diameter greater than the filament diameter and spaced very close to the filament.

Lens designs for parabolic reflector lamps are created to provide uniform distribution of light. Typically, lens prescriptions provide a certain range of maximum intensity of light within a certain angular range of beam spread. For example, a maximum intensity of 13,000–15,000 candela and a beam spread of 10–12 degrees at 50% of this maximum value. In lamps having a conductive support extending axially along the light source, prior art lens designs have not been satisfactory in reducing the shadow in the light beam caused by the axial support.

Accordingly, it is an object of the invention to reduce shadowing in the light beam caused by light source supports disposed between the light source and the reflector.

SUMMARY OF THE INVENTION

The above objects are accomplished in a reflector lamp of the type described in the opening paragraph in that a plurality of said elongate beam forming elements have oblique portions defined by a respective pair of side edges each extending from an inner end to an outer end of said oblique portions at an acute angle to a radius extending from the optical axis of the reflector through the inner end of the side edges. Such oblique portions have been found to be effective in reducing shadowing caused by the axial support. In a desirable embodiment, the beaming forming elements are oblique over their entire length.

According to one embodiment, the side edges extend non-linearly from the inner to the outer ends of the oblique portions. In a favorable embodiment, the side edges are curved according to an arc of circle. The curved side edges were found to contribute to shadow reduction.

According to the preferred embodiment, the reflector body has a substantially parabolic reflective surface having a focus and defining an optical axis. The light source is elongate, disposed focally within the reflector surface, and aligned with the optical axis. Support means for supporting the light source comprises a current conductor extending the axial length of the light source between the light source and the reflector. The beam forming elements are flutes which are oblique over their entire length. The flutes are regularly arranged, contiguous with each other, and are curved and tapered.

These and other aspects of the invention are more fully described with reference to the drawings and the detailed description.

DESCRIPTION OF THE PREFERRED EMBODIMENT

Figure 1:
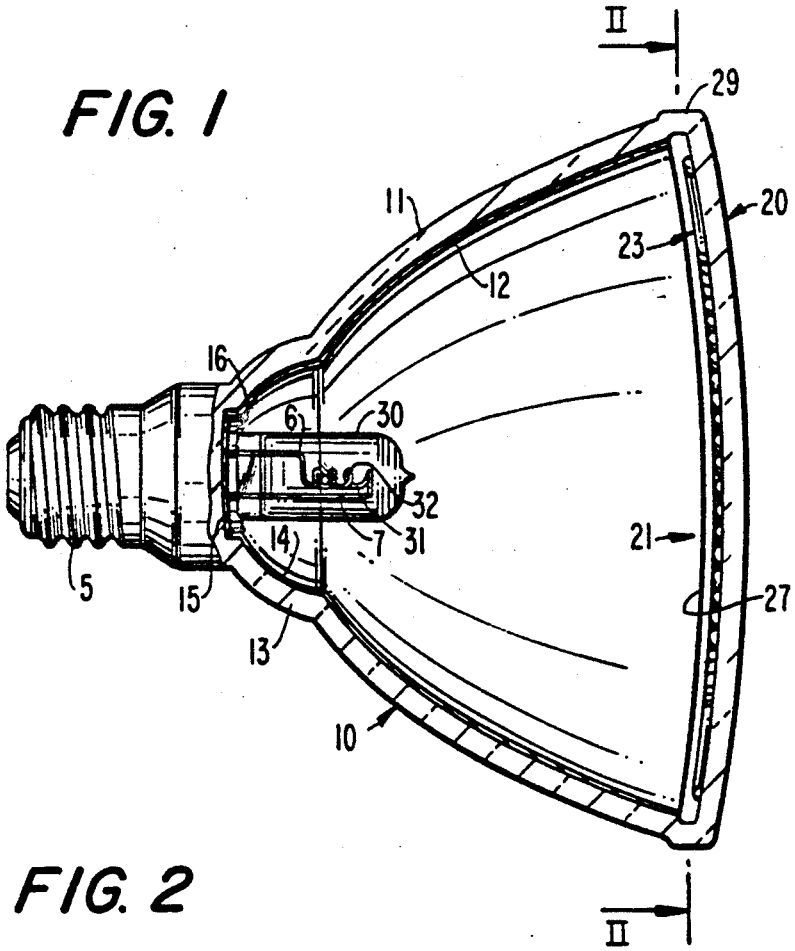
FIG. 1 is a cross-sectional, side elevation of a spot lamp according to the invention.

FIG. 1 shows a PAR-type reflector lamp, in particular a PAR 38 spot lamp, having a reflector body 10, a lens 20, and a light source 30 disposed within the reflector and substantially surrounded thereby. The light source 30 shown is a conventional tungsten-halogen light capsule, but may be a conventional tungsten filament, or a high intensity gas discharge (HID) arc tube. Capsule 30 is supported within reflector 10 and electrically connected to a conventional medium screw base 5 by rigid current conductors 6, 7.

The reflector 10 is conventional and consists of hard glass. The reflector body has a first (front) parabolic section 11, a second (middle) spherical section 13 and a third (rear) spherical section 15. The radius of the spherical surface 14 of the middle section 13 is centered at the principle focus 31 of the parabolic reflective surface 12 of the first section 11.

Capsule 30 includes elongate filament 32 which is axially aligned with the optical axis A of the reflector. The conductor 7 extends the axial length of the capsule adjacent thereto, and thus interferes With light emanating from the filament 2 and striking reflective surfaces 12, 14, and 16, causing shadowing of the light projected from reflector 10.

Figure 2:
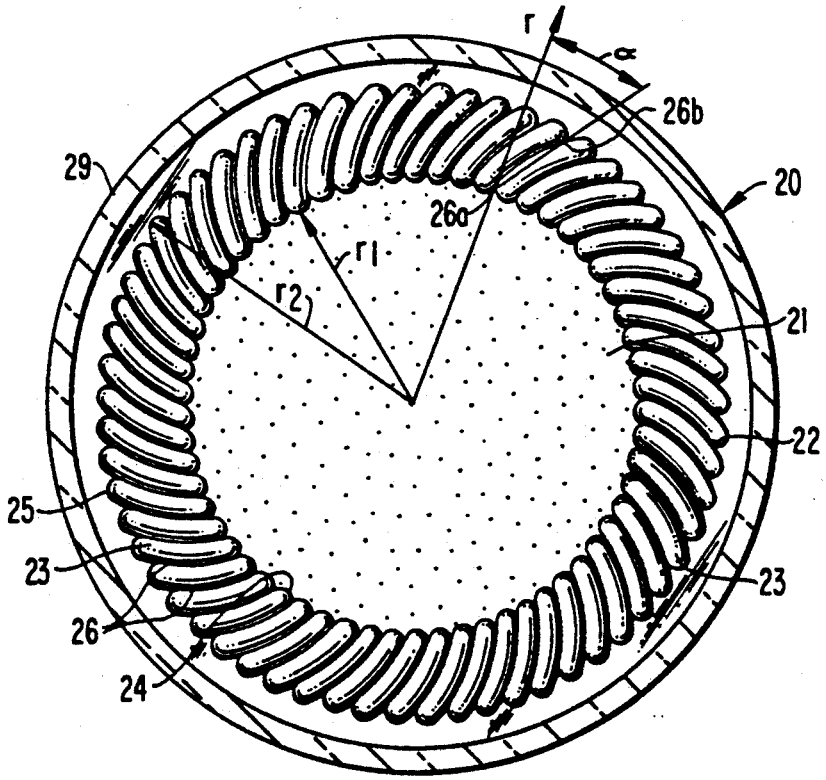
FIG. 2 is an elevational view of the internal surface of the lens of the invention as taken along the line II—II in FIG. 1.

FIG. 2 shows a preferred embodiment of a lens according to the invention which is effective for reducing shadowing in the beam pattern. The lens 20 is circular in configuration and has an inner concave surface 27 and an outer surface 28 substantially parallel thereto which is smooth. (FIG. 1) Inner surface 27 has a conventional stippled central portion 21 surrounded by annular portion 22 comprised of a plurality of contiguous beam forming elements in the form of oblique flutes 23.

Each flute extends from an inner end 24 adjacent the central portion to an outer end 25 adjacent the outer rim 29 of the lens and includes a pair of side edges 26. The side edges extend non linearly and are defined by an arc of circle. The flute ends 24, 25 have semi-circular edges which smoothly join with the side edges 26 at their inner and outer ends 26*a*, 26*b*, respectively. The flute side edges 26 each extend from its inner end 26*a* to its outer end 26*b* at an acute angle $\alpha$ to a respective radius r which extends from the optical axis A through the inner end 26*a* of the side edge. The acute angle $\alpha$ is measured from a straight line extending through the inner end 26*a* and outer end 26*b* of the side edges to the respective radius extending through the inner end 26*a*. The side edges 26 define the oblique portion of the flutes, which in this embodiment is the entire length of the flutes.

The flutes are tapered in height, as measured normal to inner surface 27, as well as in width, as measured between the side edges. Both the height and width increase in the direction towards the outer rim 29. FIG. 3*a* shows a longitudinal cross-sectional view through one flute 23. At the flute end 24 nearest the center of the lens the flute height $h_1$ was about 0.0483 cm and at the outer end 25 the flute height $h_2$ was about twice that of $h_1$, or 0.0965 cm.

Figure 3B:
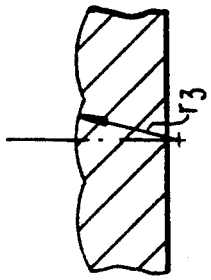
FIG. 3*b* shows a transverse cross-sectional view of the flute.
Figure 3A:
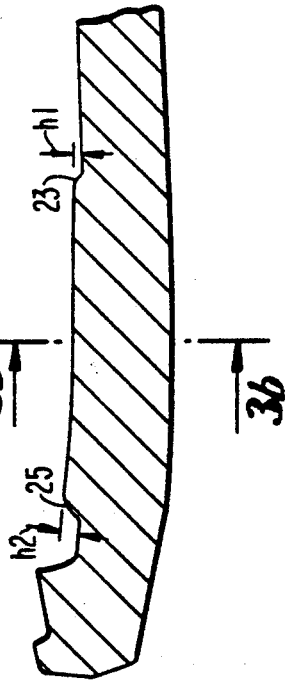
FIG. 3*a* is a longitudinal cross-sectional view showing a preferred form of the flutes.

FIG. 3*b* shows a cross-section perpendicular to the axis of one of the flutes 23 showing the smoothly curved flute surface defined by an arc of circle $r_3$. In the lens of FIG. 2, $r_3$ was about 0.445 cm. The fluted surfaces were not stippled.

It is understood that all flutes in FIG. 2 are of identical size and configuration. In the example of FIG. 2, the inner radius $r_1$ of the annular portion was about 3.81 cm while the outer radius $r_2$ was about 5.52 cm. The rim 29 has an external diameter of approximately 12.06 cm. The annular portion 22 contains a total of 60 contiguous flutes, each covering an arc of six (6) degrees. Each pair of flutes has a respective common side edge 26.

Figure 4:
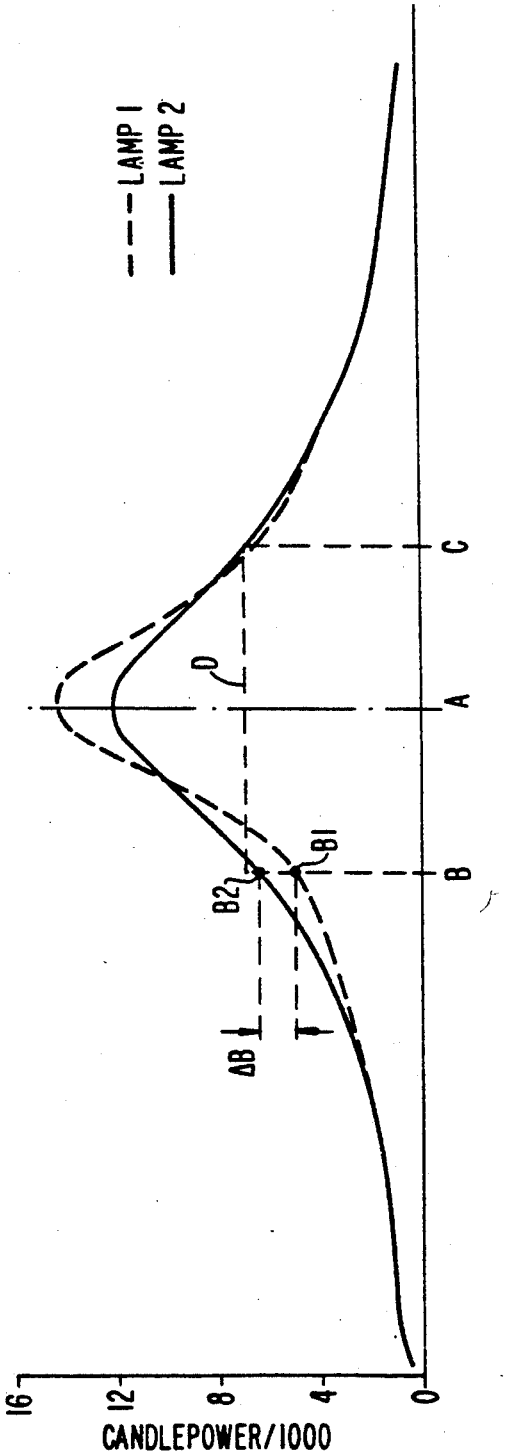
FIG. 4 is a graph of candle power verses degrees (from lamp axis) illustrating the reduced shadowing provided by the lens according to the invention as compared to a prior art lens.

FIG. 4 is an overlay of two candlepower distribution curves which illustrates the reduced shadowing provided by a reflector lamp having a lens according to FIG. 2. The curves were obtained from a three dimensional mapping of the beam distributions of two 75 W reflector lamps, identical but for their lens. The dashed line is the candlepower in one axial plane through the optical axis for a lamp ("Lamp 1") having a prior art lens with a central octagonal stippled portion and a regular pattern of circular lenticules surrounding the stippled portion (make: Philips Lighting Company model "X3"). The solid line is the candlepower on the same plane for a lamp having a lens according to FIG. 2 ("Lamp 2").

In FIG. 4, the line marked "A" is the optical axis. The vertical line marked "B" is spaced the same number of degrees from the optical axis as the vertical line marked "C". At line C, the candlepower was about equal for both lamps. At line B, both lamps exhibited reduced candlepower as compared to line C due to shadowing. However, the candle power for Lamp 1 (point B1) was considerably less than the candle power for Lamp 2 (point B2). The difference $\Delta B$ between B2 and B1 represents the reduction in shadowing (higher candlepower) for the lamp according to the invention as compared to prior art Lamp 1. Lamp 2 also shows improved uniformity about the optical axis as compared to the prior art Lamp 1. The improved uniformity is due to the reduction in shadowing provided by the lens according to the invention. While only one focal plane has been shown, it is understood that similar reductions in shadowing and improvements in beam uniformity occur in other axial planes through the optical axis as well.

It is noted that the difference in maximum candlepower on the lamp axis is merely a function of stippling densities between Lamp 1 and Lamp 2 in the central portion of the lens, and is not indicative of a reduction in maximum candlepower by the oblique flutes of the lens according to the invention. Increased maximum candle power on the optical axis can be achieved through reduced stippling density in the central portion of the lens. A 75 W reflector lamp having a lens with a reduced stippling density as compared to Lamp 2 above had a maximum candlepower of 14,350 candela and a beam spread of 9 degrees at 50% of this maximum value.

The lamp according to the invention was also found to have reduced shadowing as compared to a lamp having radially extending straight flutes according to U.S. Pat. No. 4,506,316.

While there have been shown what are considered the preferred embodiments of the invention, it will be obvious to those of ordinary skill in the art that various changes and modifications may be made to the invention without departing from the scope of the invention as defined by the appended claims. For example, the stippling density, radius of the stippled portion, the number and cross-sectional shape of the oblique flutes and their length may all be varied depending on the size and configuration of the reflector and the light source.

The flutes may also have, for example, an inner radially extending portion and an outer obliquely extending portion.

What is claimed is:

1. In a reflector lamp having a reflector defining an optical axis, a light source disposed within said reflector and substantially surrounded thereby, and a lens adjacent said reflector having an annular portion which includes a pattern of elongate beam forming elements, the improvement comprising:

a plurality of said elongate beam forming elements having oblique portions defined by a respective pair of side edges each extending from an inner end to an outer end of said oblique portions at an acute angle to a respective radius extending from said optical axis through said inner end of said side edges.

2. In a reflector lamp according to claim 1, wherein said side edges extend non-linearly from said inner ends to said outer ends of said oblique portions.

3. In a reflector lamp according to claim 2, wherein said side edges are curved according to an arc of circle.

4. In a reflector lamp according to claim 3, wherein said oblique portions are tapered in width between said side edges and have a narrower width at said inner end than at said outer end.

5. In a reflector lamp according to claim 4, wherein a plurality of said oblique portions are contiguous and have common side edges.

6. In a reflector lamp according to claim 5, wherein said light source is aligned with said optical axis.

7. In a reflector lamp according to claim 1, wherein said oblique portions are tapered in width between said side edges and have a narrower width at said inner end than at said outer end.

8. In a reflector lamp according to claim 1, wherein said oblique portions of said beam forming elements are curved according to an arc of circle.

9. In a reflector lamp according to claim 1, wherein a plurality of said oblique portions are contiguous and have common side edges.

10. In a reflector lamp according to claim 1, wherein said light source is aligned with said optical axis.

11. A PAR lamp, comprising:

a) a reflector body having a substantially parabolic reflective surface having a focus and defining an optical axis;

b) an elongate light source disposed focally with aid parabolic reflective surface and aligned with said optical axis;

c) support means for supporting said light source comprising a rigid current conductor extending between said light source and said reflective surface along the axial length of said light source; and d) a lens sealed to said reflector body, said lens having a central surface portion and an annular fluted surface portion substantially surrounding said central portion and concentric with said optical axis, said fluted portion comprising a plurality of regularly arranged contiguous oblique flutes each extending from a inner end adjacent a stippled portion to an outer edge adjacent an outer rim of said lens, said flutes each having common side edges extending between said flute ends at an acute angle to a respective radius extending from said optical axis through an inner end of said side edges.

12. A PAR lamp according to claim 11, wherein said flute side edges are curved in the plane of said fluted surface portion.

13. A PAR lamp according to claim 12, wherein said flute side edges are curved according to an arc of circle.

14. A PAR lamp according to claim 13, wherein each flute is tapered in width between said side edges and has a narrower width at said inner flute end than at said outer flute end.

15. A PAR lamp according to claim 14, wherein said flutes vary in height between said inner and outer flute ends.

16. A PAR lamp according to claim 15, wherein said central surface portion is stippled.

* * * * *